United States Patent [19]

McNeill

[11] Patent Number: 4,972,944

[45] Date of Patent: Nov. 27, 1990

[54] FOUR CELLED ARTICLE CARRIER

[75] Inventor: Michael R. McNeill, Hawthorn Woods, Ill.

[73] Assignee: United Packaging Company, Elk Grove Village, Ill.

[21] Appl. No.: 415,967

[22] Filed: Oct. 2, 1989

[51] Int. Cl.[5] ..... B65D 75/00

[52] U.S. Cl. ..... 206/188; 206/162; 206/170; 206/180; 206/189; 229/117.14

[58] Field of Search ..... 206/162, 163, 170, 174, 206/180, 188, 189, 193, 427, 434, 139; 229/117.06, 117.14

[56] References Cited

U.S. PATENT DOCUMENTS

| | | | |
|---|---|---|---|
| 2,563,620 | 8/1951 | Ringler | 206/163 |
| 2,719,649 | 10/1955 | Gilbert | 206/189 |
| 2,811,279 | 10/1957 | Arneson | 206/162 |
| 2,846,114 | 8/1958 | Ringler | 206/163 |
| 2,932,424 | 4/1960 | Arneson | 206/188 |
| 3,602,392 | 8/1971 | Cote | 206/189 |
| 4,250,992 | 2/1981 | Gilbert | 206/162 |
| 4,838,414 | 6/1989 | Blackman | 206/188 |

*Primary Examiner*—David T. Fidei

*Attorney, Agent, or Firm*—Allegretti & Witcoff, Ltd.

[57] ABSTRACT

A multi-celled article carrier suitable for conveying articles such as cans and bottles, and a method for manufacturing the article carrier are disclosed. The article carrier preferably comprises four cells defined by a bottom wall, two side panels and two end walls. The article carrier is divided into cells by the combination of a medial partition extending from end wall to end wall and by a transverse partition extending from side panel to side panel to form four distinct cells. The medial partition further comprises an integral perforated handle consisting of two handle portions which cause the article carrier to become erected when united to form the perforated handle.

8 Claims, 5 Drawing Sheets

Fig. 6
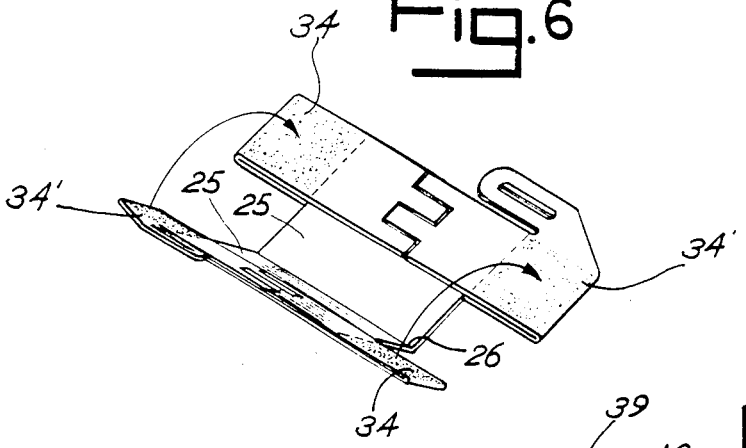
Fig. 7
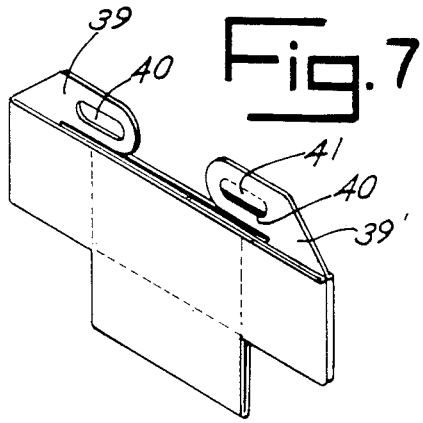
Fig. 8
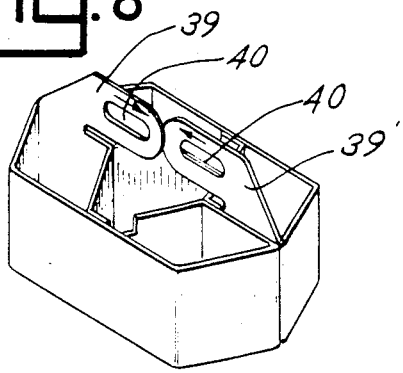
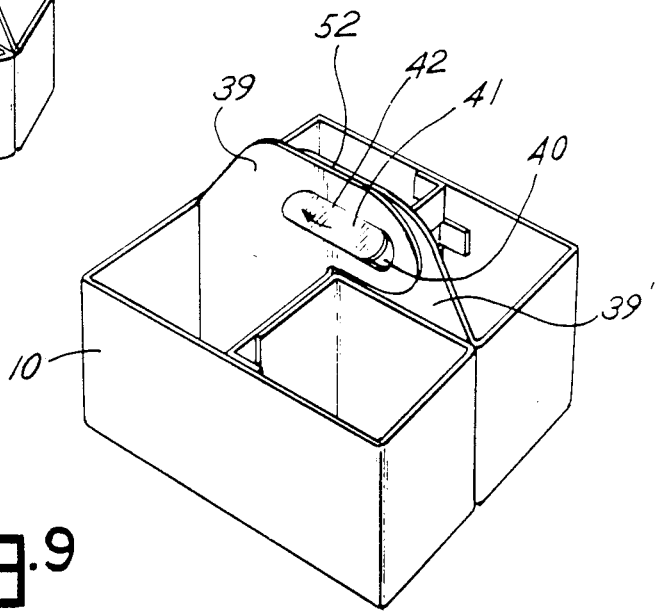
Fig. 9

Fig. 10
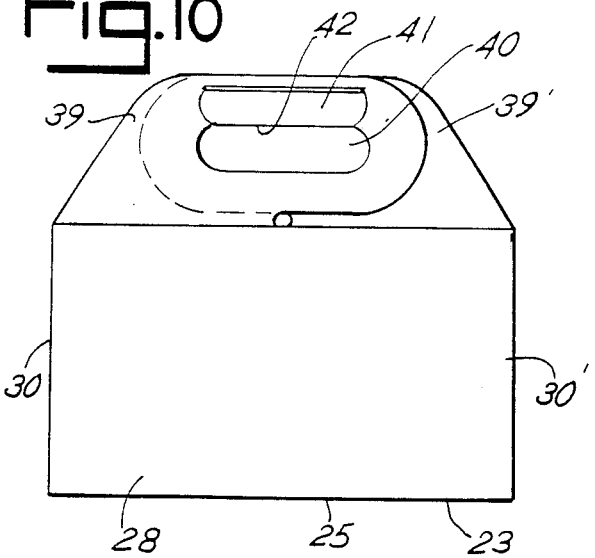
Fig. 11
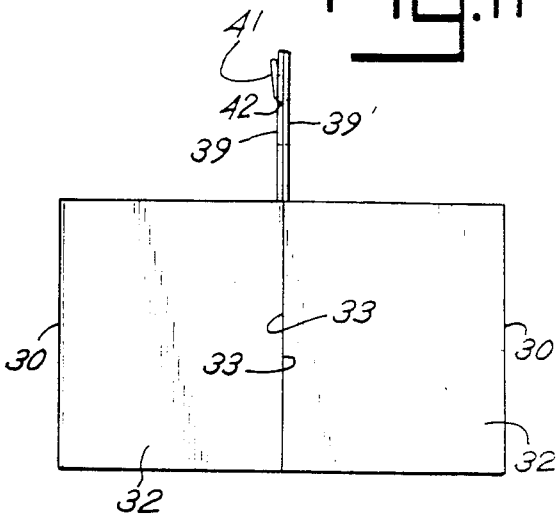
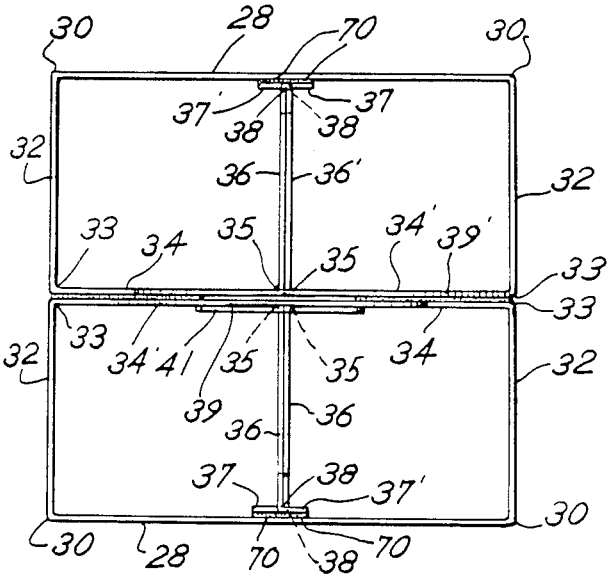
Fig. 12
Fig. 12a
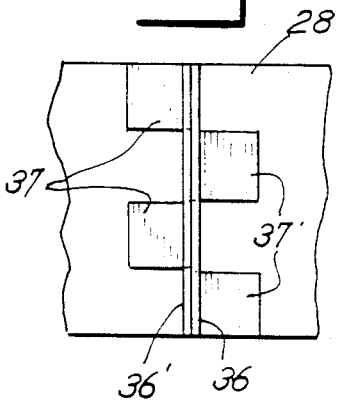
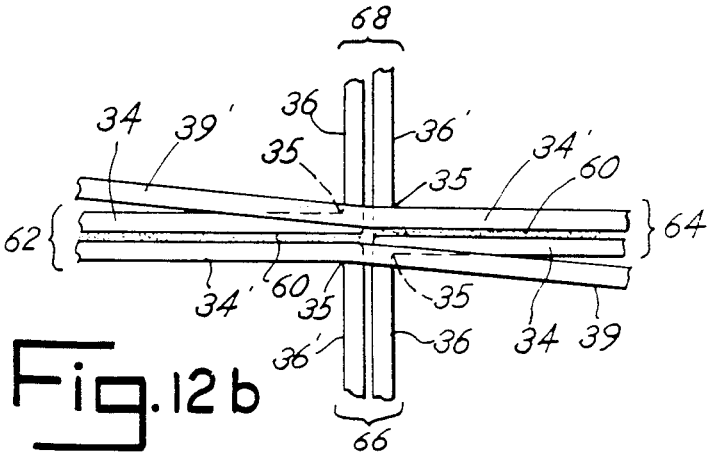
Fig. 12b

FOUR CELLED ARTICLE CARRIER

BACKGROUND OF THE INVENTION

1. Field Of The Invention

The present invention relates generally to a multi-celled article carrier and a method of manufacturing such an article carrier. The multi-celled article carrier is capable of being produced from a single piece of corrugated material using conventional manufacturing methods. The multi-celled article carrier is further capable of being quickly assembled such that the partitions defining the cells are self-positioning to enable the article carrier to be quickly and efficiently loaded with cans, bottles, or other similar articles. The multi-celled article carrier of this invention is preferably four-celled and is designed and constructed to support relatively heavy articles weighing on the order of three pounds in each cell of the multi-celled carrier.

2. The Prior Art

U.S. Pat. No. 2,525,686 describes a collapsible compartmented carton having a handle. The carton contains six discrete cells and is manufactured from a single piece of material. The carton further comprises a handle portion which is made up of two foldably adjacent handle panels.

U.S. Pat. No. 2,846,114 discloses a collapsible bottle carrier produced from a single piece of paperboard material. The carrier has six cells, each cell defined in part by a wall comprising small panels adhesively attached to the sidewalls of the bottle carrier.

U.S. Pat. No. 2,917,202 discloses a four cell compartmented carton with a handle. The four-celled carton comprises a hinged handle on the transverse portion of the carton. The medial walls of the carton are adhesively attached along a uniform plane to the side walls of the carton.

U.S. Pat. No. 4,610,349 discloses a four pack bottle carrier. The four pack bottle carrier comprises discrete cells of varying vertical heights. The four pack carrier also contains a handle that is comprised of three separate panel portions.

U.S. Pat. No. 4,338,414 discloses a basket-like carrier formed from the distinct types of material blanks. The carrier depicted in the patent has four cells. The handle of the carrier is formed from at least two perpendicularly associated handle panels.

SUMMARY OF THE INVENTION

It is an object of this invention to provide a multi-celled article carrier and a method for manufacturing such an article carrier which is capable of being quickly assembled from a single unitary blank and then speedily loaded on a production line.

It is another object of this invention to provide a multi-celled article carrier, preferably having four cells, and a method for producing such an article carrier in which the partitions defining the cells are self positioning upon erection of the article carrier and which will support relatively heavy articles in each cell.

This invention relates generally to a multi-celled article carrier which is capable of being efficiently assembled from a single unitary blank and quickly loaded on a production line. The multi-celled article carrier of this invention comprises a bottom wall, two side panels, and two end walls. The multi-celled article carrier is divided into cells by a transverse partition structure perpendicularly associated with a medial partition. The medial partition comprises the combination of two opposing perforated handle portions defining a perforated handle. The multi-celled article carrier defined above is constructed from an H-shaped blank of creased material comprising an intermediate section perpendicularly attached to both a first extension and second extension. The intermediate section further comprises a creasably attached first and second bottom panel which combine to define the bottom wall. The first and second extensions each further comprise a side panel which divides the first and second extensions each into two opposing leg sections. Each leg section is further divided by creases into three panels to define a top panel, a medial panel, and a transverse panel. Each transverse panel consists of one or more finger panels bisected by a crease. The medial panels of two laterally or diagonally opposed leg sections each contain an integral perforated handle portion.

A preferred embodiment of the multi-celled article carrier of this invention comprises a bottom wall, two side panels creasably attached to the bottom wall and two end walls. Each end wall includes two end panels wherein each end panel is creasably attached to a side panel. The multi-celled article carrier also contains a medial partition including laterally adjacent first and second medial partition structures. Each medial partition structure further includes two adhesively attached congruent medial panels wherein each medial panel is creasably attached to an end panel. The multi-celled article carrier also comprises a transverse partition having laterally adjacent first and second transverse partitions. The laterally adjacent first and second transverse partitions each consist of two congruent transverse panels wherein each transverse panel is creasably attached to a medial panel. Each transverse panel has a single finger panel which is adhesively attached to the inner dimension of a side panel such that the parallel spaced finger panels is oriented perpendicularly away from the medial panel to which it is foldably attached. A perforated handle is formed from a first and second perforated handle portion. Each perforated handle portion is integral to a medial partition structure and extends beyond the boundary of the medial partition structure defined by the location of the crease attaching a medial panel to a transverse panel.

The invention also comprises a method of manufacturing a multi-celled article carrier from a unitary H-shaped blank of material. The method comprises cutting an H-shaped piece of material from a roll or sheet of stock and then creasing the H-shaped piece to form a creased H-shaped blank having an intermediate section perpendicularly attached to a first extension and a second extension. The H-shaped blank is creased to define a plurality of panels such that the intermediate section is divided into a creasably attached first and second bottom panel which combine to define the bottom wall of the erect multi-celled article carrier. The H-shaped piece is also creased such that the first and second extensions each comprise a side panel creasably attached to the bottom wall. The side panel further divides the first and second extensions each into two opposing leg sections. Each leg section is further divided by creases into three panels to define an end panel, a medial panel, and a transverse panel. Each transverse panel further comprises one or more finger panels each finger panel bisected by a crease. The medial panel of two laterally or diagonally opposed leg sections each contain an integral perforated handle portion.

To construct the multi-celled article carrier, an adhesive is applied to the upwardly facing dimensions of the finger panel(s) to define an adhesive containing finger panel dimension. Adhesive is also attached to adhesive site on the side panels. Each leg section is folded at the crease dividing the medial panel and the end panel so that the adhesive containing parallel spaced finger panel dimension of the finger panel(s) becomes adhesively attached to the adhesive site(s) on the side panel of the creased H-shaped blank. A small H-shaped work piece is defined by so folding all leg sections. Adhesive is applied to the medial panel of each leg section of the small H-shaped work piece to define an adhesive containing medial panel face. The small H-shaped work piece is folded at the crease dividing the bottom panels to adhesively attach the foldably opposing adhesive containing medial panel faces. The multi-celled article carrier is erected by directing the integral perforated handle portions of the medial panels together to define a perforated handle.

These as well as other objects and advantages of the present invention will become more apparent upon review of the following detailed description of the invention.

BRIEF DESCRIPTION OF THE DRAWINGS

There is shown in the attached drawings a presently preferred embodiment of the present invention, wherein like numerals in the various views refer to like elements and wherein:

FIG. 2(*a*) depicts the preferred H-shaped blank of this invention.

FIGS. 3–9 illustrate the sequence of steps comprising the method of manufacturing a four-celled article carrier of this invention from the scored H-shaped blank depicted in FIG. 2;

FIG. 10 is a front view of an erected four-celled article carrier;

FIG. 11 is a side view of an erected four-celled article carrier; and

FIG. 12 is a top view of an erected four-celled article carrier of this invention;

FIG. 12(*a*) is a close-up view of the relationship of the parallel spaced finger panels with the congruent transverse partition panel and the side panel; and FIG. 12(*b*) is a close-up view of the center structure of an erected four-celled article carrier.

DETAILED DESCRIPTION OF THE INVENTION

The present invention comprises a multi-celled article carrier and a method of manufacturing a multi-celled article carrier.

Figure 1:
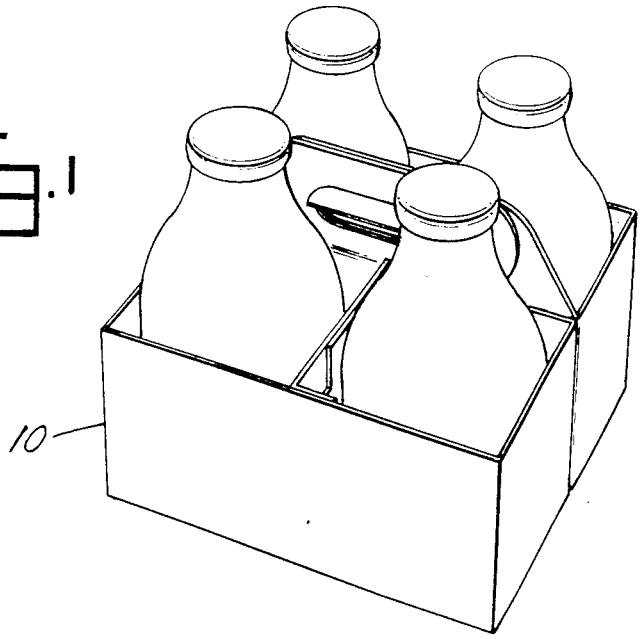
FIG. 1 is a perspective view illustrating a preferred embodiment of the multi-celled article carrier of the present invention, assembled and loaded with bottles.

The multi-celled article carrier of this invention is better understood by reference to FIGS. 1–12 which show various aspects of the preferred four-celled article carrier. FIG. 1 shows a four-celled article carrier 10 of this invention as it would appear in its erected form containing articles such as bottles in each of the four cells.

Figure 2:
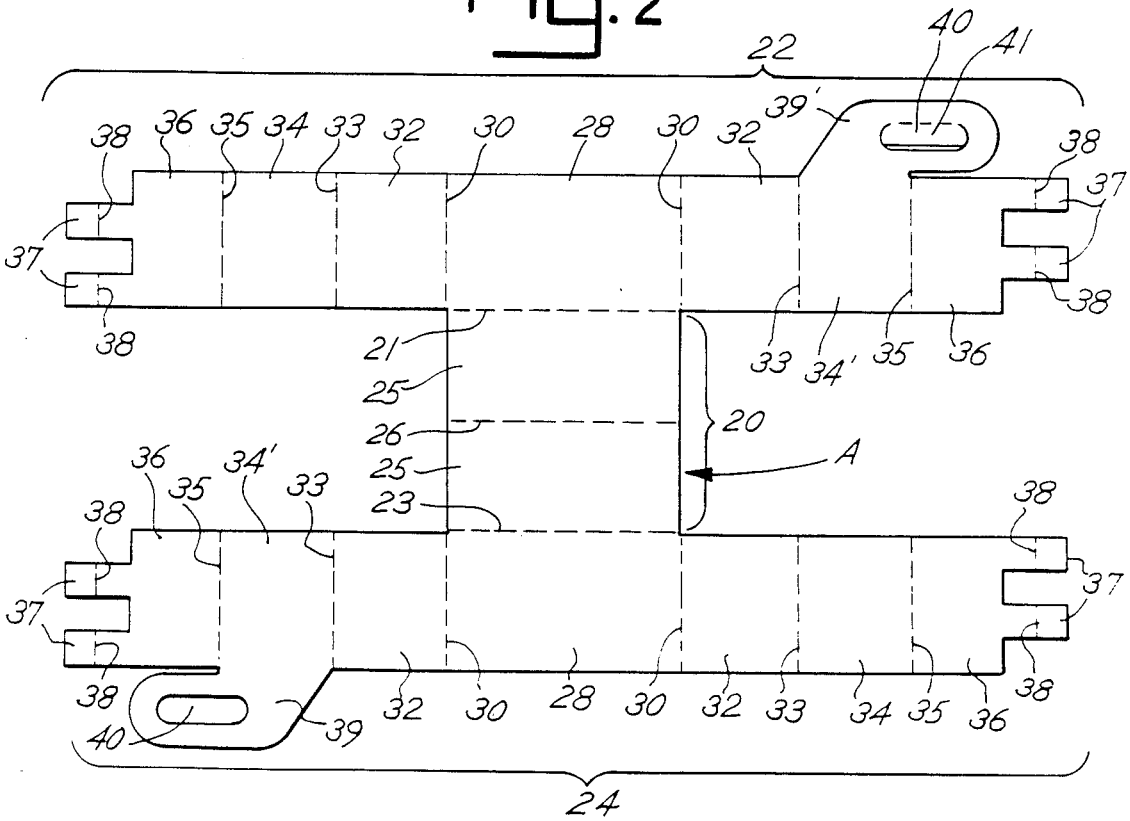
FIG. 2 is a view showing the scored H-shaped blank from which a four-celled article carrier of the present invention can be made.
Figure 2:
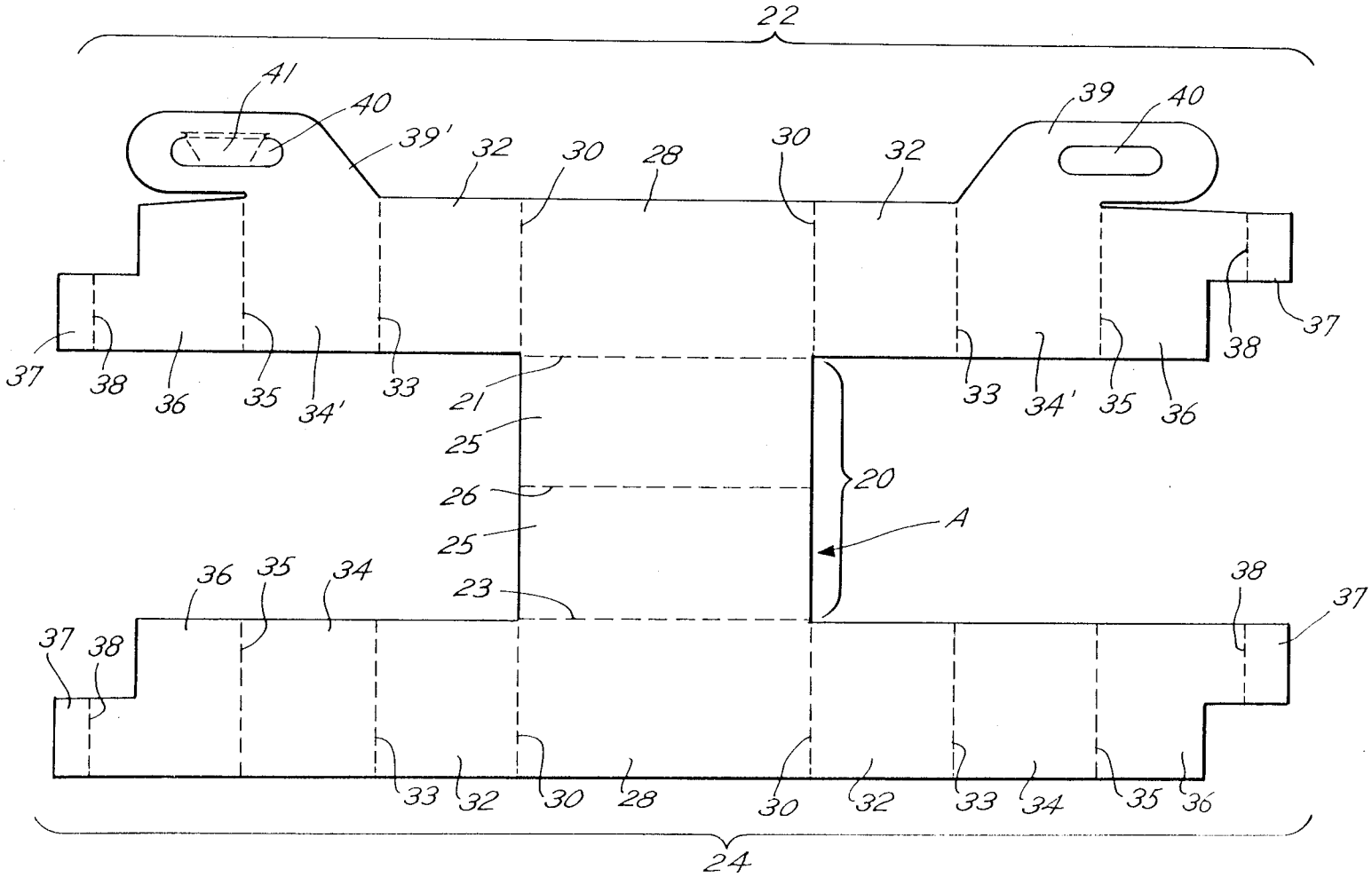

FIGS. 2 and 2(*a*) show a creased H-shaped blank of material that has been cut out of a large piece of material. Both embodiments of the creased H-shaped blank are useful in constructing the preferred four-celled article carrier of this invention. The crease locations effectively divide the H-shaped blank into discrete panels. The term "creasably attached" as used herein means that one panel is attached to another at the crease line or score line defining the border between the two panels. The creased H-shaped blank A comprises an intermediate section 20 perpendicularly attached by crease 21 to first extension 22 and also perpendicularly attached by crease 23 to second extension 24. The first extension 22 and the second extension 24 are oriented parallel to one another.

The intermediate section 20 further comprises two adjacent bottom panels 25 attached by crease 26 to define a bottom wall.

The first extension 22 includes a side panel 28 connected to a bottom panel 25 by crease 21. The second extension 24 includes a side panel 28 connected to a second bottom panel 25 by crease 23.

The side panels 28 divide the first extension 22 and second extension 24 respectively into two opposing leg sections such that the first extension 22 has two opposing leg sections and the second extension 24 has two opposing leg sections. Each leg section is attached to side panel 28 by crease 30.

Each leg section further comprises an end panel 32, a medial panel 34 or 34', and a transverse panel 36. End panel 32 is attached to medial panel 34 or 34' by crease 33. Medial panel 34 or 34' is attached to transverse panel 36 by crease 35. Each transverse panel further comprises one or more finger panels 37. Each finger panel 37 contains a crease 38 bisecting each finger panel 37. Two opposing medial panels 34' contain an integral handle portion 39 or 39'. In FIG. 2, diagonally opposing medial panels 34' contain integral handle portions 39 or 39'. In FIG. 2(*a*) laterally opposing medial panels 34' contain integral handle portions 39 or 39'. Each integral handle portion 39 or 39' also contains a perforation 40. Finally, integral handle portion 39' also contains an optional locking panel 41.

Figure 3:
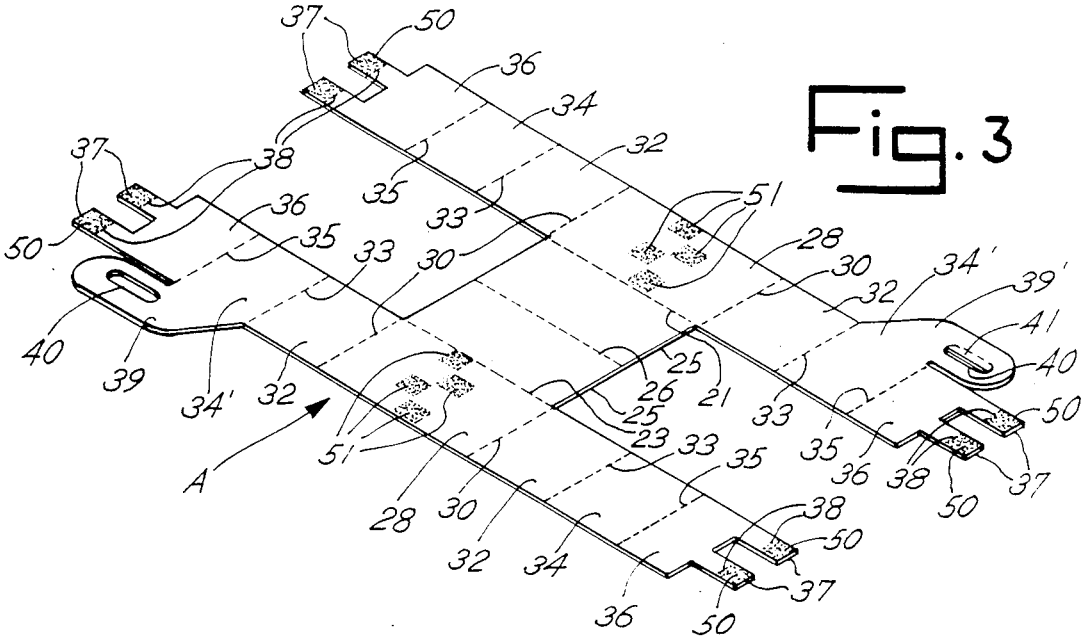

The four-celled article carrier of this invention is manufactured by subjecting the creased H-shaped blank A as shown, for example, in FIG. 2 to a sequence of manufacturing steps shown in FIGS. 3–9. FIG. 3 shows the initial manufacturing step of applying an adhesive to adhesive sites 50 and 51 on the creased H-shaped blank A. Adhesive sites 50 are located on the upwardly facing dimension of the portion of the finger panel(s) 37 bisected by crease 38 which is farthest from transverse panel 36. Adhesive sites 51 are located on the side panels 28 such that adhesive sites 51 will correspond to the location and dimension that the selected adhesive sites 50 on the finger panel(s) 37 will occupy when each leg section of the creased H-shaped blank is folded at crease 33 to bring the upwardly facing dimension of the finger panel(s) 37 into contact with each side panel 28.

Figure 4:
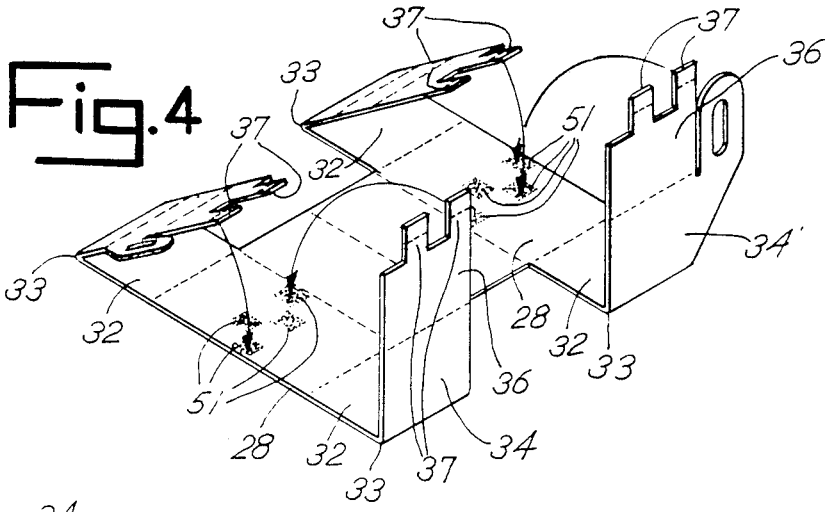

FIG. 4 shows each of the four leg sections of the creased H-shaped blank 18 being folded at crease 33 dividing the end panel 32 from medial panels 34 or 34'. The leg section portion being folded in FIG. 4 consists of the medial panels 34 or 34' and the transverse panels 36 including the finger panel(s) 37. Each leg section of the creased H-shaped blank is folded 180° into contact with the upwardly facing dimension of side panels 28. At this point, the adhesive site(s) 50 of the finger panel(s) 37 become adhesively attached to the adhesive site(s) 51 on side panels 28 to form a small H-shaped work piece.

Figure 5:
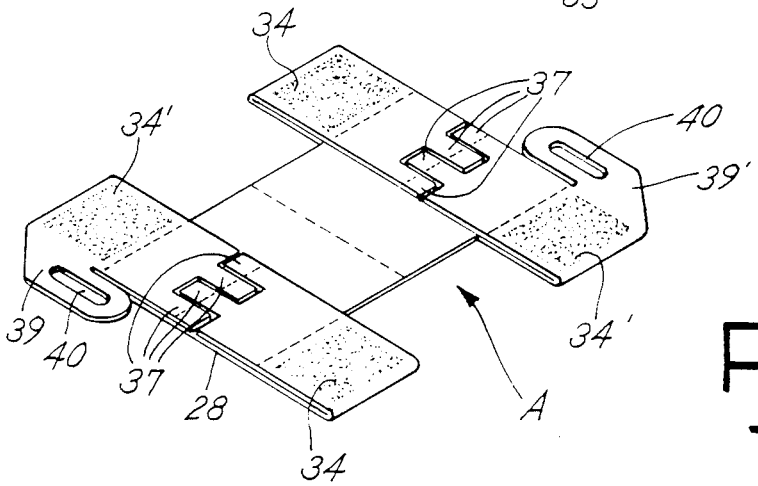

FIG. 5 shows the creased H-shaped blank A of this invention after the plurality of parallel spaced finger panels 37 have been adhesively attached to the side panels 28 to define the small H-shaped work piece. The small H-shaped work piece is prepared for the next assembly step by applying an adhesive material to the upwardly facing medial panels 34 and 34'. The adhesive is not applied to the integral handle portion 39 of medial panels 34'.

FIG. 6 shows the small H-shaped work piece being folded at crease 26 which divides bottom panels 25. The small H-shaped work piece is folded such that the upwardly facing dimension of the adhesive containing medial panels 34 and 34' are brought into contact with one another as shown in FIG. 7.

FIG. 7 depicts the four-celled article carrier of this invention in collapsed form. The collapsed article carrier contains two opposing integral handle portions 39 and 39' each containing a perforation 40. Integral handle portion 39' also contains an optional locking panel 41 creasably attached to a perforation dimension.

A four-celled article carrier is erected according to FIG. 8 by directing the two integral handle portions 39 and 39' towards each other such that the perforations 40 of each integral perforated handle portion 39 and 39' meet to form a single perforated handle 52 as shown in FIG. 9.

FIG. 9 shows the final step in manufacturing a four-celled article carrier 10 of this invention. The single perforated handle 52 is constructed of two integral handle portions 39 and 39'. The integral handle portions 39 and 39' each contain a perforation 40 and are held together by locking panel 41 which attached by crease 42 to a dimension of the handle perforation 40 of integral handle portion 39'. The locking panel 41 is essentially identical in dimension to handle perforation 40. The locking panel 41 is extended through the handle perforation 40 of integral handle portion 39 to which the locking panel 41 is not attached such that the locking panel becomes wedged in the upper portion of the handle perforation 40 thereby holding the integral perforated handle portions 39 and 39' together to form a single perforated handle 52.

FIGS. 10, 11 and 12 show front, side and top views of a four-celled article carrier of this invention erected from the H-shaped blank of FIG. 2. FIGS. 10–12 and 12(*a*) and 12(*b*) are discussed simultaneously below. The four-celled article carrier consists of two side panels 28, each of which are attached to a bottom panel 25 by crease 21 or crease 23. The side panels 28 are attached by crease 30 to end panels 32. Two end panels 32 laterally combine to define an end wall of the four-celled article carrier. Each end panel 32 is attached by crease 33 to a medial panel 34 or 34'. Medial panel 34 is attached to its congruent medial partition panel 34' by adhesive 60 located in between geometrically opposing medial panels 34 and 34'. The adhesively attached medial panels 34 and 34' form a first medial partition structure 62 laterally adjacent to a second medial partition structure 64. The combination of laterally adjacent first and second medial partition structures 62 and 64 define the medial partition of the four-celled article carrier.

The four-celled article carrier also consists of a first transverse partition 66 and a second transverse partition 68 which are both perpendicularly associated with the medial partition. First transverse partition 66 and second transverse partition 68 are each formed by two congruent transverse panels 36 and 36'. Each transverse panel 36 and 36' is attached to a medial panel 34 or 34' by crease 35 and also consist of one or more finger panels 37 which are each bisected by crease 38. The finger panels 37 are perpendicularly folded at crease 38 towards the partition panel 36 or 36' to which the finger panels 37 are not attached. The folded finger panels 37 are attached to the inside face of a side panel 28 by adhesive 70 located between the folded plurality of finger panels 37 and the inside face of side panel 28. This orientation of the finger panels 37 results in a zipper-like final structure which is shown in FIG. 12(*a*). In FIG. 12(*a*), a plurality of finger panels 37 are creasably attached to transverse panel 36 in a perpendicular relationship such that the finger panels 37 are folded towards transverse panel 36' and adhesively attached to the inner dimension of side panel 28. Likewise, finger panels 37' are creasably attached to transverse panel 36' in a perpendicular relationship such that finger panels 37' are adhesively attached to the inner dimension of side panel 28.

The four-celled article carrier further comprises a perforated handle integral to the carrier. The integral perforated handle consists of two integral handle portions 39 and 39'. When the carrier is erected the perforations 40 of the integral handle portions 39 and 39' are congruent with one another. The integral handle portions 39 and 39' are held in place by locking panel 41 to form the integral perforated handle. Locking panel 41 is attached to a dimension of the perforation 40 of integral handle portions 39' by crease 42.

The relationship of the medial partition with the transverse partition structure is better understood by reference to FIG. 12(*b*). FIG. 12(*b*) shows a close-up overhead view of the center structure of a four-celled article carrier of this invention. The transverse partition structure is formed by the lateral combination of laterally adjacent first transverse partition 66 and laterally adjacent second transverse partition 68. The laerally adjacent first and second transverse partition panels 66 and 68 are each defined by congruent transverse panels 36 and 36'. Each transverse panel 36 and 36' is connected by crease 35 to a medial panel 34 or 34'.

A medial panel 34 and a medial panel 34' are attached by adhesive 60 to define a first medial partition structure 62. A second discrete pair of medial panels 34 and 34' are adhesively attached to define a second medial partition structure 64. The first and second medial partition structures 62 and 64 laterally combine to form the medial partition of the four-celled article carrier.

In addition, each medial partition panel 34' contains an integral handle portion 39 or 39' which extends above and beyond the medial partition panel 34' to which it is integral.

The multi-celled article carrier of this invention is capable of conveying various cylindrical and noncylindrical articles. The article carrier is most useful in conveying bottles, cans and similarly shaped containers. The article carrier of this invention is very useful in holding and conveying bottles and cans weighing from about 4 to 6 pounds or much more. It is preferred that the multi-celled article carrier of this invention consist of four cells, each cell capable of holding a discrete heavy article.

The preferred article carrier of this invention may be constructed of any material known which is capable of being folded from a single flat sheet into the four-celled article carrier of this invention. The material chosen must be capable of imparting structural strength to the erected article carrier. Such a material might for example be a thick plastic sheet-type material or a paperboard material. It is preferred that the four-celled article carrier of this invention be constructed from paperboard.

It is further preferred that the four-celled article carrier of this invention be constructed from a single piece of creased paperboard which has been cut out from a sheet or roll of paperboard stock. The paperboard cutout that is used to construct the four-celled article carrier of this invention is unique in that it is an H-shaped blank, and also in that it is characterized as comprising essentially identical opposing first and second extensions. By essentially identical opposing first and second extensions, it is meant that the H-shaped blank comprises parallel opposing first and second extensions. Each extension is further divided into two opposing leg sections. Each leg section is identical except that two of the four medial panels making up the four leg sections contain an internal perforated handle portion. These integral perforated handle portion containing medial panels cause the opposing first and second extensions to be less than idential.

The two medial panels which contain internal perforated handle portions are preferably located on laterally opposed legs of the same extension. They are alternatively located on diagonally opposing legs on opposite extensions.

The four-celled article carrier of this invention retains its three dimensional structure in part due to the adhesive attachment of the finger panels, which are integral to the transverse partition panels, to the inside dimension of the side walls. It is preferred that each transverse partition panel contain one finger panel bisected by a crease. Alternatively, each transverse partition panel may contain two or more finger panels, each finger panel being parallel to and separated by a blank space from an adjacent finger panel.

The adhesive used herein may be any adhesive known which is capable of attaching one piece of material to another, and especially known to be able to adhesively attach cardboard. The adhesive may include but is not limited to glue, paste, resins, polymers or other similar materials. The adhesive may be applied as a bead or in any other manner sufficient to adhesively attach to separate pieces of material.

The four-celled article carrier of this invention also comprises a single perforated handle which is constructed of two handle portions. The handle is perforated as are both handle portions. Each handle portion is integral to laterally or diagonally opposed medial panels in the completed four-celled article carrier. Each of the integral handle portions are integral to one set of the two sets of lateral or diagonally opposed medial panels of the H-shaped blank of paperboard material when the H-shaped cutout piece is folded into the four-celled article carrier of this invention. The handle portions integral to lateral or diagonally opposed medial panels become opposed to one another when the container is in a collapsed position. In fact the four-celled article carrier of this invention is erected by drawing the two integral handle portions towards one another to form a single perforated handle and thereby also form an erected four-celled article carrier.

It is an additional aspect of the four-celled article carrier of this invention that one of the perforated handle portions is creasably attached along one dimension of the perforation with a locking panel. The locking panel is essentially equivalent in dimension to the perforation of each handle portion. The locking panel is extended through the perforation of the adjacent perforated handle portion and folded at least to a position perpendicular to that of the handle portion. This procedure locks the two handle portions into place to form a single perforated handle. The locking procedure ensures that the four-celled article carrier does not collapse by way of the two handle portions becoming disengaged from one another.

While a presently preferred embodiment of the invention has been shown and described, it is apparent changes and modifications may be made therein without departing from the invention. Therefore, it is intended in the appended claims to cover all changes and modifications as fall within the true spirit and scope of the invention.

What is claimed is:

1. A four-celled article carrier comprising a bottom wall, two side panels, two end wall, and divided into cells by a transverse partition structure perpendicularly associated with a medial partition, the medial partition comprising two opposing perforated handle portions defining a perforated handle, the multi-celled article carrier being constructed from an H-shaped blank of creased material comprising an intermediate section perpendicularly attached to both a first extension and a second extension, the intermediate section further including a creasably attached first and second bottom panel to define the bottom wall, the first and second extensions each further including a side panel dividing the first and second extensions each into two opposing leg sections, each leg section being further divided by creases into three panels to define a top panel, a medial panel, and a transverse panel, each transverse panel consisting of one or more finger panels each finger panel bisected by a crease, with the medial panel of two leg sections each containing an integral perforated handle portion.

2. The four-celled article carrier of claim 1 further characterized in that one of the integral perforated handle portions contains a locking panel.

3. The four-celled article carrier of claim 1 further characterized in that it is constructed from a single piece of paperboard.

4. The four-celled article carrier of claim 1 further characterized in that each medial panel consists of a single finger panel, bisected by a crease.

5. The four-celled article carrier of claim 1 further characterized in that the two perforated handle portions are integral to diagonally opposed medial panels on the H-shaped blank.

6. The four-celled article carrier of claim 1 further characterized in that the two perforated handle portions are integral to adjacent medial panels on the H-shaped blank.

7. The four-celled article carrier of claim 1 further characterized in that the perforations of the handle portions are essentially equivalent in dimension and in that one of the perforated handle portions is creasably attached along one dimension of the perforation to a locking panel essentially equivalent in dimension to the perforation.

8. A four-celled article carrier comprising a bottom wall; two side panels creasably attached to the bottom wall; two end walls, each end wall including two end panels, each end panel creasably attached to a side panel; a medial partition consisting of laterally adjacent first and second medial partition structures, each medial partition structure further consisting of two adhesively attached congruent medial panels, each medial panel creasably attached to an end panel; a transverse partition consisting of laterally adjacent first and second transverse partitions, the first and second transverse partitions each consisting of two congruent transverse panels, each transverse panel creasably attached to a medial panel and containing a single finger panel which is adhesively attached to the inner dimension of a side panel such that the finger panel is oriented perpendicularly away from the medial panel to which it is attached; and a perforated handle formed from a first and second perforated handle portion, each perforated handle portion integral to a medial partition structure and extending beyond the boundary of the medial partition structure defined by the location of the crease attaching a medial panel to a transverse panel.

* * * * *